US008082686B2

(12) United States Patent
Campbell et al.

(10) Patent No.: US 8,082,686 B2
(45) Date of Patent: Dec. 27, 2011

(54) CLEATED ATHLETIC SHOE WITH CUSHION STRUCTURES

(75) Inventors: Derek Campbell, Columbia, MD (US); Kevin Fisher, Baltimore, MD (US); Michael N. White, Cockeysville, MD (US)

(73) Assignee: Under Armour, Inc., Baltimore, MD (US)

( * ) Notice: Subject to any disclaimer, the term of this patent is extended or adjusted under 35 U.S.C. 154(b) by 447 days.

(21) Appl. No.: 12/404,098

(22) Filed: Mar. 13, 2009

(65) Prior Publication Data

US 2010/0229427 A1 Sep. 16, 2010

(51) Int. Cl.
*A43B 13/20* (2006.01)
*A43B 5/00* (2006.01)

(52) U.S. Cl. ..... 36/134; 36/67 R; 36/67 D

(58) Field of Classification Search ..... 036/134, 036/67 R, 67 D, 126, 127, 128, 61
See application file for complete search history.

(56) References Cited

U.S. PATENT DOCUMENTS

| | | | | | |
|---|---|---|---|---|---|
| 2,911,738 | A * | 11/1959 | Clerke | 36/134 |
| 3,739,499 | A * | 6/1973 | Morin | 36/127 |
| 4,470,207 | A * | 9/1984 | Bente | 36/134 |
| 4,561,197 | A * | 12/1985 | Misevich | 36/127 |
| 4,843,735 | A * | 7/1989 | Nakanishi | 36/28 |
| 4,858,343 | A * | 8/1989 | Flemming | 36/128 |
| 5,377,431 | A * | 1/1995 | Walker et al. | 36/134 |
| 5,743,029 | A * | 4/1998 | Walker et al. | 36/134 |
| 5,775,005 | A * | 7/1998 | McClelland | 36/31 |
| 6,029,377 | A * | 2/2000 | Niikura et al. | 36/67 R |
| 6,050,006 | A * | 4/2000 | Swindle | 36/134 |
| 7,254,909 | B2 * | 8/2007 | Ungari | 36/61 |
| 2007/0251128 | A1 * | 11/2007 | Yen | 36/134 |

FOREIGN PATENT DOCUMENTS

DE 3924360 A1 * 1/1991

* cited by examiner

*Primary Examiner* — Marie Patterson
(74) *Attorney, Agent, or Firm* — Oblon, Spivak, McClelland, Maier & Neustadt, L.L.P.

(57) ABSTRACT

A cleated shoe is presented which provides cushion support and lateral stability in a lightweight construction. The shoe includes a lower and an upper. The lower may include a primary midsole, cushion elements, and an outsole. A cleat may be connected to the outsole. At least one cushion may be located between the primary midsole and outsole. Various embodiments of cushions are presented and may be consistent with specific types of shoes associated with various types of activities such as football, baseball, lacrosse, soccer, or golf. The lower may be consistent with approaches to remediate a wearer's pronation or supination.

25 Claims, 8 Drawing Sheets

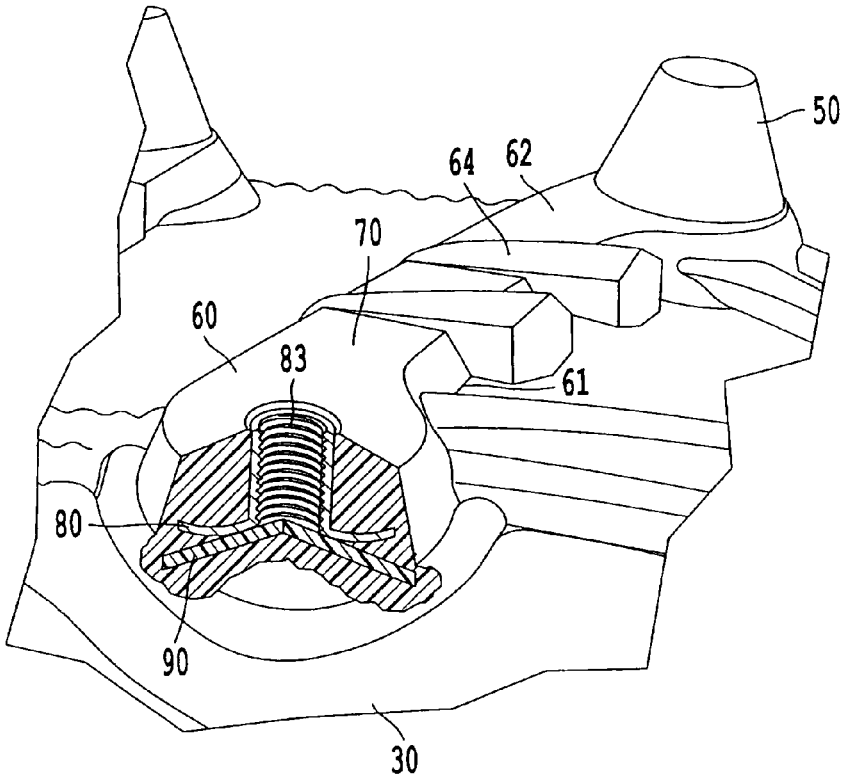
*Fig. 5*
*Fig. 6A*
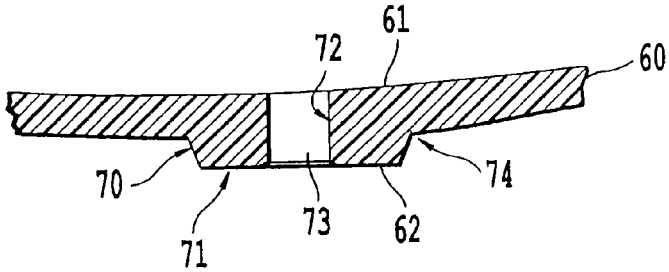
*Fig. 6B*
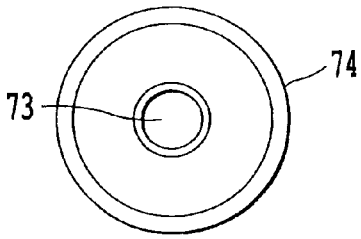

CLEATED ATHLETIC SHOE WITH CUSHION STRUCTURES

BACKGROUND

1. Field of the Invention

This invention relates to footwear having an upper and a lower, more specifically to a cushion structure integrated as part of a cleat included in the lower.

2. Description of the Related Art

The modern shoe is a system of various parts, all contributing an important part to the performance of the athlete and to the support, comfort, and protection of the athlete's foot. There are specialized shoes designed for athletes in very different activities from: football, baseball, lacrosse, soccer, and golf. Each of these activities require a special blend of performance specifically tied to weight, traction, support, comfort, and protection. Shoes may also be customized for the user's physical characteristics such as the user's weight, shoe size and gait (i.e. pronated, supinated, neutral). Specifically, the weight, cushioning, and lateral stability characteristics of a shoe can be a strong determinant of performance because they may directly impact an athlete's speed, endurance, and sure-footing.

There have been previous attempts to create shoe cleats to improve shock absorption, stability, and traction. Yet these efforts have produced overly stiff shoes, shoes with inadequate lateral stability, or unnecessarily heavy shoes not meeting the requirements of serious athletes and active athletic participants.

Although foregoing efforts have been met with varying degrees of success, there remains an unresolved need for cleated athletic footwear with improved shock absorption, lateral stability, and low weight. The problem is that the previous shoe technology does not provide the level of shock absorption required by the wearer for demanding applications without an unacceptable stiff sole, heavier weight, or high center of gravity. There are additional issues to consider such as the shoe's flexing characteristics as shock absorbing materials are used that might compromise measures to control pronation or other undesirable walking or running characteristics of the wearer.

SUMMARY

One aspect of the present invention is to address and resolve the above-noted limitations with conventional footwear wherein the integration of shock absorption elements unsatisfactorily compromises lateral stability, increases the weight, or increases the thickness of the midsole.

In a first aspect, the present invention may include a lower adapted to attached to an upper. The lower may include a primary midsole, an outsole, a cushion, and a cleat. The primary midsole may be sized to be the full length of the wearer's foot. The outsole may be attached to the bottom of primary midsole. The cleat may be connected to the outsole. The cushion may be made of a flexible planar material and attached to the bottom surface of the primary midsole and disposed between the primary midsole and the outsole. The cushion may be located only above the cleat. There may be open space between the primary midsole and the outsole to allow the cushion edges to expand when under compression forces. The components may be attached together using cement glue or a general epoxy adhesive.

In a second aspect, the lower may include a primary midsole, an outsole, a cushion, a cleat, and a disk cylinder. The outsole may be attached to one or more cleats. Each cleat may be attached to the outsole at a hollow raised protrusion. The hollow raised protrusion may have opening at the bottom surface and may include a disk cylinder. The disk cylinder may be located inside the hollow raised protrusion and provide an interface to attach the cleat to the outsole through the opening in the outsole. The interface may be an interference or a threaded mechanical interface to attach the cleat to the outsole. The cushion may be made of a flexible planar material and attached to the bottom surface of the primary midsole and disposed between the primary midsole and the cleat. The cushion may contact a top surface of the disk cylinder and/or a perimeter of the hollow raised protrusion. There may be open space between the primary midsole and the outsole to allow the cushion edges to expand when under compression forces. The components may be attached together using cement glue or a general epoxy adhesive.

In a third aspect, there may be more than one cleat attached to the outsole. Adjacent hollow raised protrusion may be associated with adjacent cleats may be connected by an outsole bridge that may contact the ground. The outsole bridge may provide extra support for the adjacent cleats as they come under stress during activity. Further, the outsole bridge may provide additional forward traction as the bridge established contact with the ground. The outsole bridge may include spikes to enable the bridge to more easily penetrate the ground and thereby provide more traction.

In a fourth aspect, the lower may include a primary midsole, a cushion, and an outsole, wherein a cleat is integrated in the outsole. The cushion may be made of a flexible planar material and attached to the bottom surface of the primary midsole and disposed between the primary midsole and the outsole. The cushion may be located only above the cleat.

As should be apparent, the invention can provide a number of advantageous features and benefits. It is to be understood that, in practicing the invention, an embodiment can be constructed to include one or more features or benefits of embodiments disclosed herein, but not others. Accordingly, it is to be understood that the preferred embodiments discussed herein are provided as examples and are not to be construed as limiting, particularly since embodiments can be formed to practice the invention that do not include each of the features of the disclosed examples.

BRIEF DESCRIPTION OF THE DRAWINGS

The invention will be better understood from reading the description which follows and from examining the accompanying figures. These are provided solely as non-limiting examples of the invention. In the drawings:

FIG. 5 illustrates an outsole according to an embodiment of the present invention as viewed from the bottom and medial side;

FIG. 6A illustrates a schematic of a hollow raised protrusion on the outsole according to an embodiment of the present invention as viewed from the medial side;

FIG. 6B illustrates a schematic of the hollow raised protrusion on the outsole according to an embodiment of the present invention as viewed from the top side;

DETAILED DESCRIPTION OF THE PREFERRED EMBODIMENTS

Figure 1:
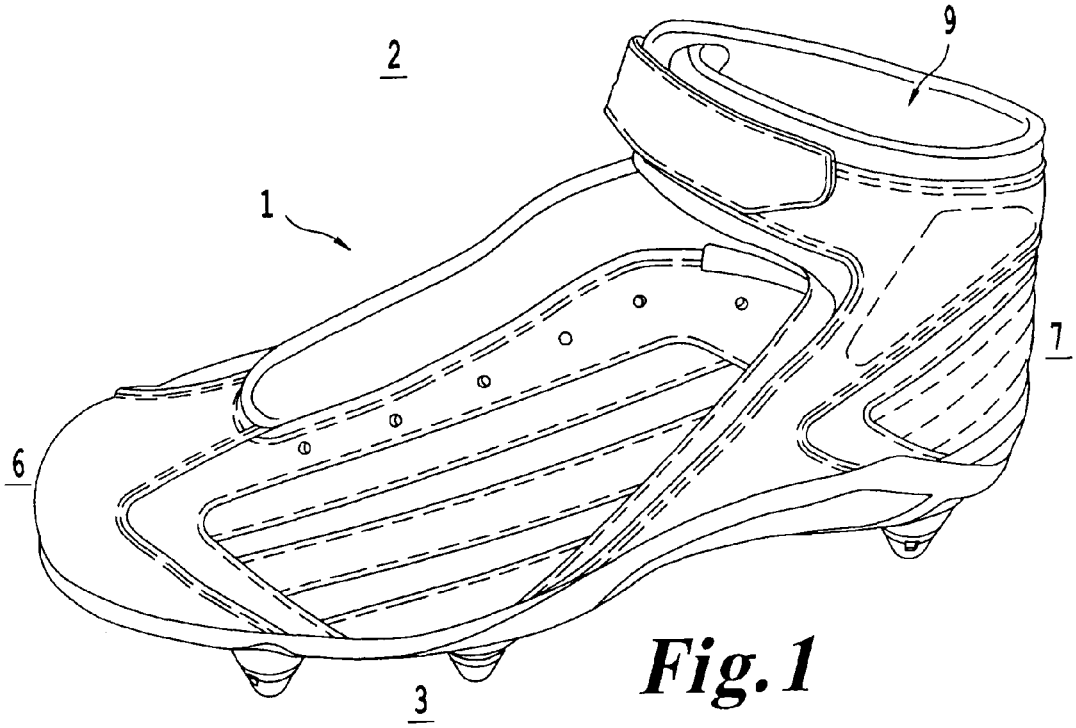
FIG. 1 illustrates a shoe according to an embodiment of the present invention.

Reference will now be made in detail to the present preferred embodiments of the invention, examples of which are illustrated in the accompanying drawings. Wherever possible, the same reference characters will be used throughout the drawings to refer to the same or like parts.

Figure 2:
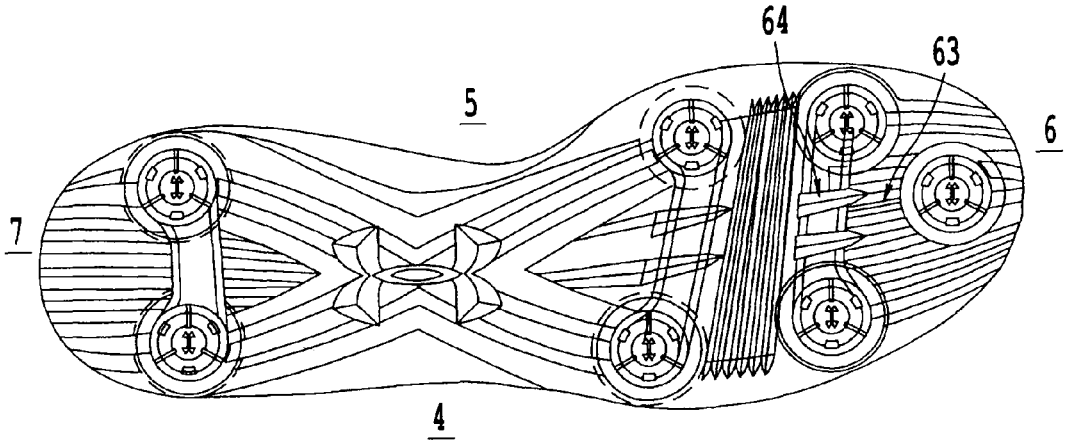
FIG. 2 illustrates the shoe according to an embodiment of the present invention as viewed from the bottom.
Figure 3:
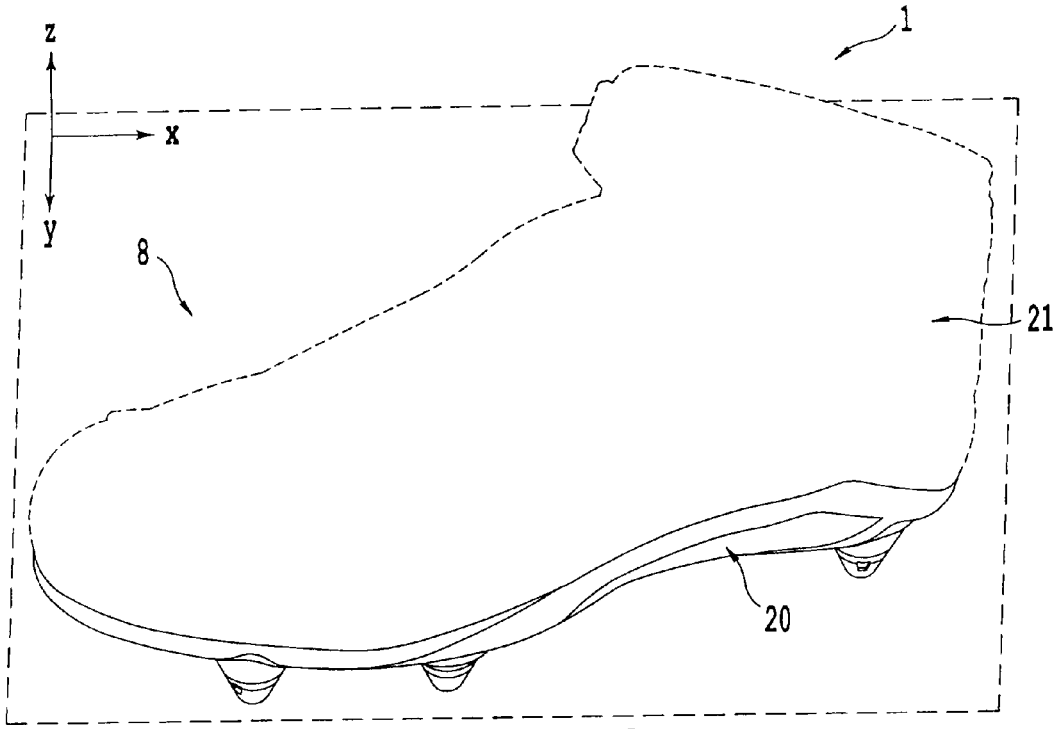
FIG. 3 illustrates a lower as part of a shoe upon the ground according to the first embodiment.

FIG. 1 illustrates a left cleated athletic shoe 1 consistent with the present invention showing an opening 9 where the wearer's foot may be inserted or withdrawn from the shoe. The shoe 1 includes both an upper 2 and a lower 3. FIG. 2 illustrates the shoe 1 from the bottom showing the lateral 4, medial 5, front 6, and back 7 sides of the shoe 1. FIG. 3 illustrates a left cleated athletic shoe 1 resting on the ground 8 consistent with the present invention showing the upper 21 and lower 20 of the shoe. A three dimensional axis shows X and Y directions as horizontal directions with respect to the ground and Z as a vertical direction.

The opening 9 may be loosened or tightened upon a portion of the wearer's foot using a variety of closures including laces, buckles, hook-and-loop fasteners, and other means. An upper 21 consistent with this disclosure may also be an assembly that merely serves the purpose of attaching the lower to the sole of the foot for a desired time period. The upper 21 may be made of various materials to optimize shoe performance in certain conditions such as leather, canvas, or synthetic materials such as plastic, artificial suede, synthetic leather, nylon weave, nylon mesh, or the like. The components of the upper 21 may be attached using stitching or an adhesive, such as cement glue.

The lower 20 may include a footbed, a midsole, and an outsole. In one embodiment the footbed may include a full length insole made of a structural member, such as cardboard, to provide stability in a construction that is known as "board lasting."

Another embodiment, called "slip lasting" replaces the structural member with a cloth structure to maximize flexibility for the shoe to twist. A further embodiment provides may be a "combination last" where the front of the shoe may be slip lasted and the back may be board lasted. Another embodiment may be a construction without the cloth structure as part of the footbed and the upper may be attached to the midsole by sewing or adhesive. The footbed may be the structural foundation of the shoe wherein the upper may be attached to the footbed with the wearer's foot between a portion of the upper and the insole. A removable sock liner may be used to provide an interface between the wearer's foot and the top of the footbed structure.

The outsole may be attached to the footbed via the midsole. The outsole provides the contact surface between the shoe and the ground. The outsole may contain a thermoplastic elastomer, a flexible polyether, a rigid polyamide, and the like. An assortment of other materials and pigments may also be used to produce different textures and colors for the outsole.

Figure 4:
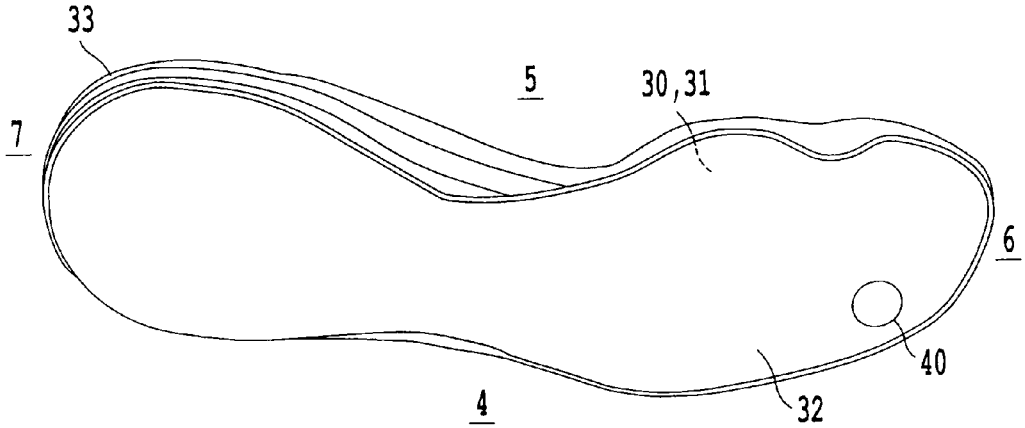
FIG. 4 illustrates a primary midsole according to an embodiment of the present invention as viewed from the top and medial side.

FIG. 4 shows a primary midsole 30 consistent with the first embodiment of the present invention. The primary midsole 30 may comprise a top midsole surface 31, a bottom midsole surface 32 and a midsole periphery edge 33. The primary midsole 30 may also have built-in arch support. At the bottom of the primary midsole 30 there may be a sunken surface 40. The primary midsole 30 may be made from ethylene vinyl acetate (EVA), polyurethane, compounds having EVA and rubber, polyether urethane, polyester urethane, ethylenevinylacetate/-polyethylene copolymer, polyester elastomer, nitrile rubber, ethylene propylene, polybutadiene, styrene-butadiene (SBR), carboxylated nitrile rubber (XNBR), and the like.

FIG. 5 illustrates an outsole 60 consistent with embodiments of the invention. The outsole 60 may include a hollow raised protrusion 70 where a cleat 50 may be attached. The outsole 60 may include a top outsole surface 61 and a bottom outsole surface 62. FIG. 2 illustrates that the outsole may have grooves 63 orientated length-wise relative the shoe 1 to improve stiffness. The outsole 60 may also include length-wise grooves 64 in the front of the outsole 60 to stiffen the outsole 60. The grooves 64 may provide additional traction for the wearer. The outsole 60 may be made of polyurethane material, thermoplastic urethane, or the like.

FIG. 6A illustrates a close-up of the hollow raised protrusion 70 from the medial side 5 consistent with the first embodiment of the invention. The outsole 60 is formed with a hollow protrusion 70 that includes a bottom raised surface 71, an outsole inner bore 72, and an outsole opening 73. As shown in FIG. 6B the hollow raised portion 70 has a primary perimeter 74. The hollow raised protrusion 70 may be made of the same material or a different material as to the rest of the outsole 60.

Figure 7:
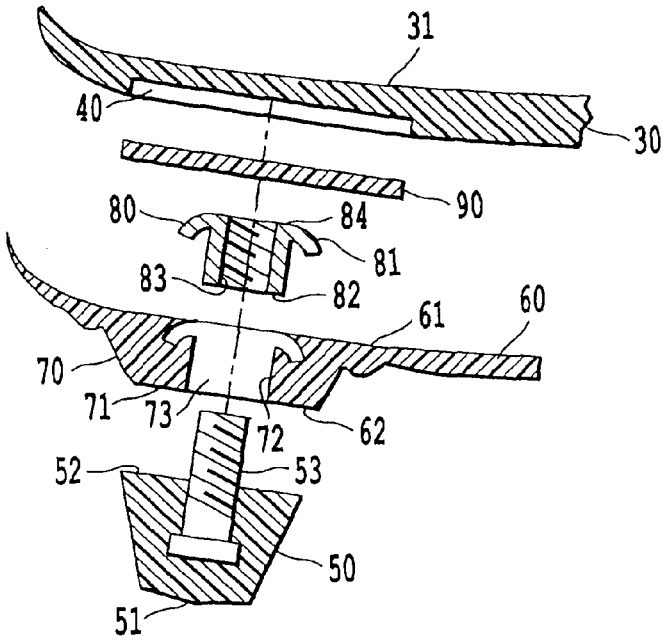
FIG. 7 illustrates an exploded schematic of a cleat assembly of the first embodiment as viewed from the medial side.
Figure 8:
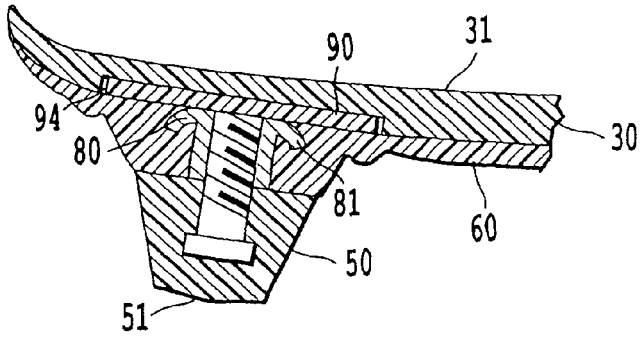
FIG. 8 illustrates a schematic of a tightened cleat assembly of the first embodiment as viewed from the medial side.

FIG. 7 illustrates a schematic close-up of the cleat assembly according to the first embodiment. In exploded view the following components are illustrated: the primary midsole 30, a cushion 90, a disk cylinder 80, the outsole 60, and the cleat 50. FIG. 8 illustrates the components fully assembled.

Figure 9:
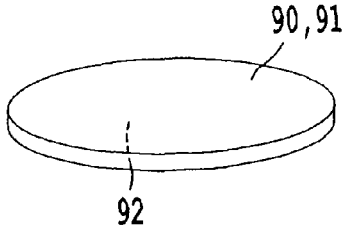
FIG. 9 illustrates a cushion according to an embodiment of the present invention as viewed from the top and medial side.

FIG. 9 shows a cushion 90 consistent with this embodiment. The cushion may be made from a flexible material having opposing sides 91, 92 (top, bottom) that are parallel or substantially parallel. These cushions may be manufactured using an injection molding process or in sheets to be cut or stamped to the desired final shapes. The shape may be designed to easily contact an interface surface on another footwear component and/or to allow optimal expansion to meet the cushioning objectives of the footwear. The shape of the cushions may be curvilinear or not. These cushions may be attached to other components using adhesive and/or attached via an interference fit.

The top surface 91 of the cushion 90 interfaces respectively with a sunken midsole area 40 on the primary midsole 30 as shown in FIG. 7. The cushion 90 may be attached to the sunken midsole area 40 via cement glue, epoxy-based adhesive, or the like. The cushion 90 may be made of polymer gel, polyurethane gel, silicone rubber, blown rubber, polyurethane foam, or the like.

The cleat 50 is shown in the schematic version in FIG. 7 consistent with the first embodiment. It may include a bottom cleat surface 51 designed to contact the ground 8. It may have a top cleat surface 52 and threaded protrusion 53 to assist in attachment to the outsole 60. The cleat may be various shapes, including a shape having circular cross section as viewed from the bottom 3.

Figure 10:
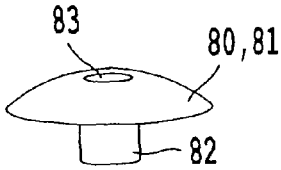
FIG. 10 illustrates a schematic of a disk cylinder according to an embodiment of the present invention as viewed from the medial side.

As shown in FIG. 7, the cleat 50 may be attached to the outsole 60 via a disk cylinder 80. The disk cylinder 80 may include a support disk 81 having a top surface 84. The support disk 81 may be circular in cross section and may also include a hollow cylindrical body 82 which includes a threaded internal bore 83 as shown in schematic in FIG. 10. The disk cylinder 80 may be attached to the top outsole surface 61 by inserting the hollow cylindrical body 82 into the outsole inner bore 72 so that the threaded internal bore 83 is accessible from the bottom outsole surface 62. The cleat 50 then may be attached to the outsole by inserting the threaded cleat protrusion 53 into the outsole opening 73 and threading the threaded cleat protrusion 53 into the threaded internal bore 83 of the disk cylinder 80 until the top cleat surface 52 may be tightly contacting the bottom raised surface 71 of the hollow raised protrusion 70. The top cleat surface 52 and the bottom raised surface 71 may include means to prevent unwanted loosening during use.

The primary midsole 30 may be attached to the outsole 60 so that the hollow raised portion 70 is positioned under the cushion 90, when the cushion 90 is disposed within the sunken midsole area 40 as shown in FIG. 8. The sunken midsole area 40 may be sized larger than the cushion 90 to allow for the cushion 90 to expand unobstructed into an empty space 94 when the cushion is compressed by the top surface 81 of the disk cylinder 80.

Figure 11:
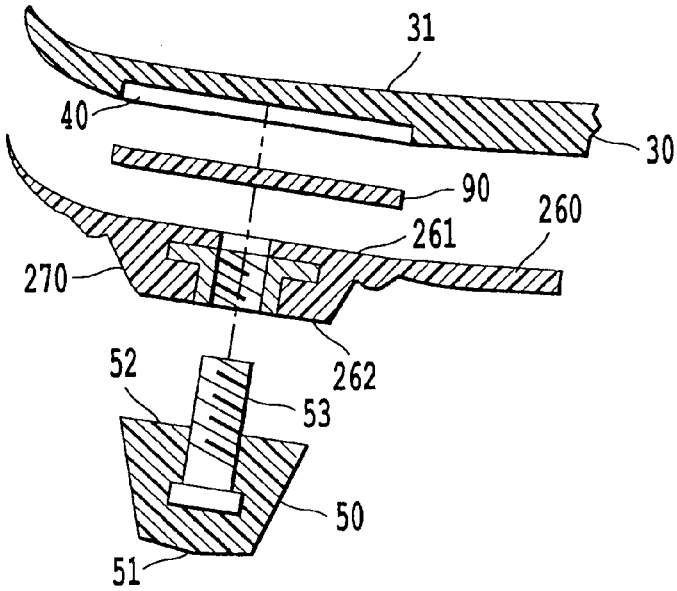
FIG. 11 illustrates an exploded schematic of a cleat assembly of the second embodiment as viewed from the medial side.

A second embodiment of a cleat assembly may be shown by FIG. 11 in exploded view. The second embodiment may include a primary midsole 30 having a sunken surface 40, a cushion 90, an outsole 260, and a cleat 50.

The outsole 260 consistent with the second embodiment may include solid raised protrusions 270 where a cleat 50 may be attached. The outsole 260 may include a top outsole surface 261 and a bottom outsole surface 262, as well as grooves 63, 64 (not shown) to improve stiffness. The outsole 260 may be made of polyurethane material, thermoplastic urethane, or the like.

Figure 12A:
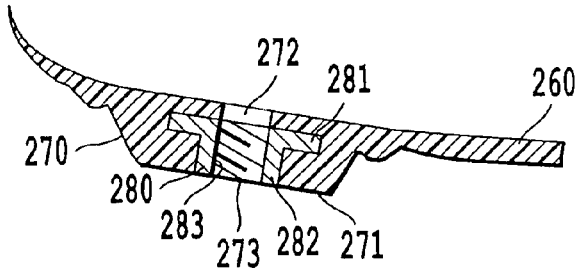
FIG. 12A illustrates a schematic of a solid raised protrusion on the outsole according to the second embodiment of the present invention as viewed from the medial side.
Figure 12B:
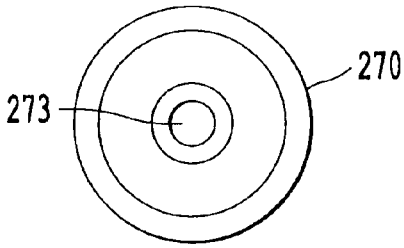
FIG. 12B illustrates a schematic of the hollow raised protrusion on the outsole according to the second embodiment of the present invention as viewed from the top side.

FIG. 12A illustrates a close-up of the solid raised protrusion 270 from the medial side 5 consistent with the second embodiment of the invention. The outsole 260 is formed with a solid protrusion 270 having a bottom raised surface 271, an outsole inner bore 272, and an outsole opening 273. The solid raised protrusion may be made of the same material or a different material as to the rest of the outsole 260 and may include a disk cylinder 280 integrated as part of the solid raised protrusion 270. The disk cylinder 280 includes a support disk 281 attached to a hollow cylindrical body 282. The hollow cylindrical body may include a threaded internal bore 283.

Figure 13:
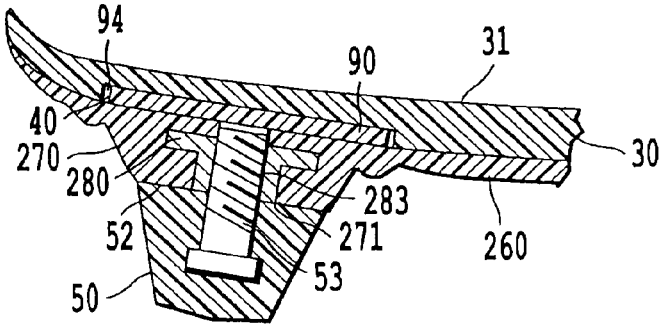
FIG. 13 illustrates a schematic of a tightened cleat assembly of the second embodiment as viewed from the medial side.

As shown in FIG. 13, the cleat 50 may be attached to the outsole 260 by inserting the threaded cleat protrusion 53 into the outsole opening 273 and threading the threaded cleat protrusion 53 into the threaded internal bore 283 of the disk cylinder 280 until the top cleat surface 52 may be tightly contacting the bottom raised surface 271 of the solid raised protrusion 270. The top cleat surface 52 and the bottom raised surface 271 may include means to prevent unwanted loosening during use.

The primary midsole 30 may be attached to the outsole 260 so that the solid raised protrusion 270 may be positioned under the cushion 90, when the cushion 90 is disposed within the sunken midsole area 40 as shown in FIG. 13. The sunken midsole area 40 may be sized larger than the cushion 90 to allow for the cushion 90 to expand unobstructed into an empty space 94 when the cushion is compressed by the top surface of the solid raised protrusion 270.

Figure 14:
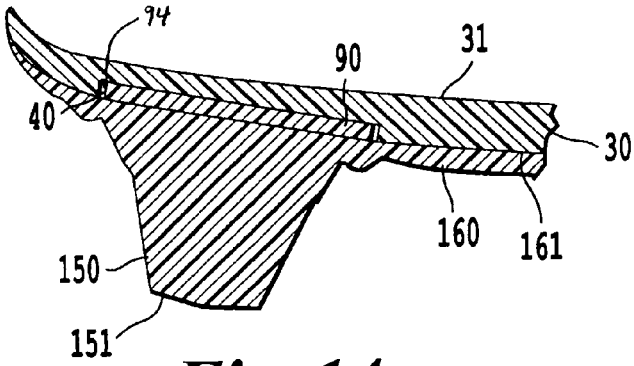
FIG. 14 illustrates a schematic of a cleat assembly of the third embodiment as viewed from the medial side.

A third embodiment of the present invention is shown in FIG. 14, may include a primary midsole 30 having a sunken surface 40, a cushion 90, an outsole 160, and a cleat 150.

The cleat 150 may be molded to the outsole 160. The cleat 150 may include a bottom cleat surface 151. The primary midsole 30 may be attached to the outsole 160 so that the cleat 150 may be positioned under the cushion, when the cushion 90 is disposed within the sunken midsole area 40 as shown in FIG. 14. The sunken midsole area 40 may be sized larger than the cushion 90 to allow for the cushion 90 to expand unobstructed into an empty space 94 when the cushion is compressed by the top surface 161 of the outsole 160. The cushion 90 may be located only above the cleat 150.

Figure 15:
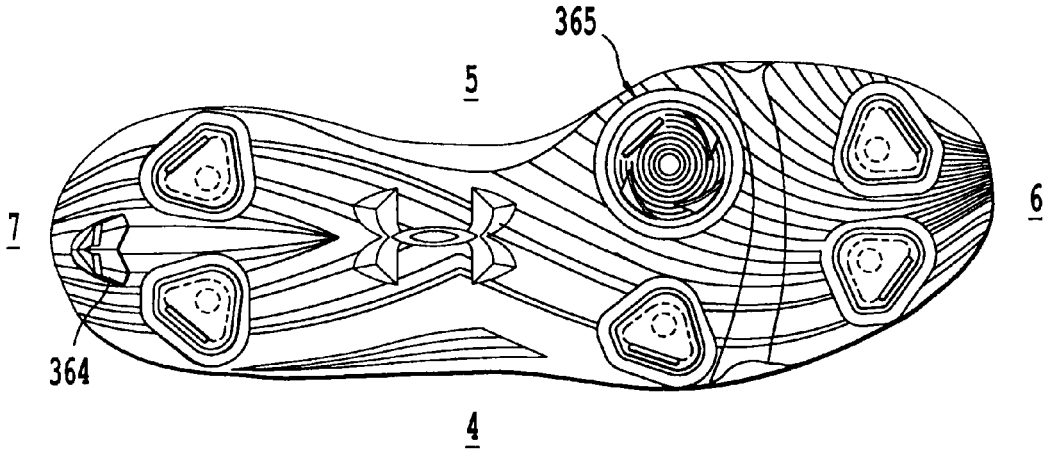
FIG. 15 illustrates the shoe according to an embodiment of the present invention as viewed from the bottom.
Figure 16:
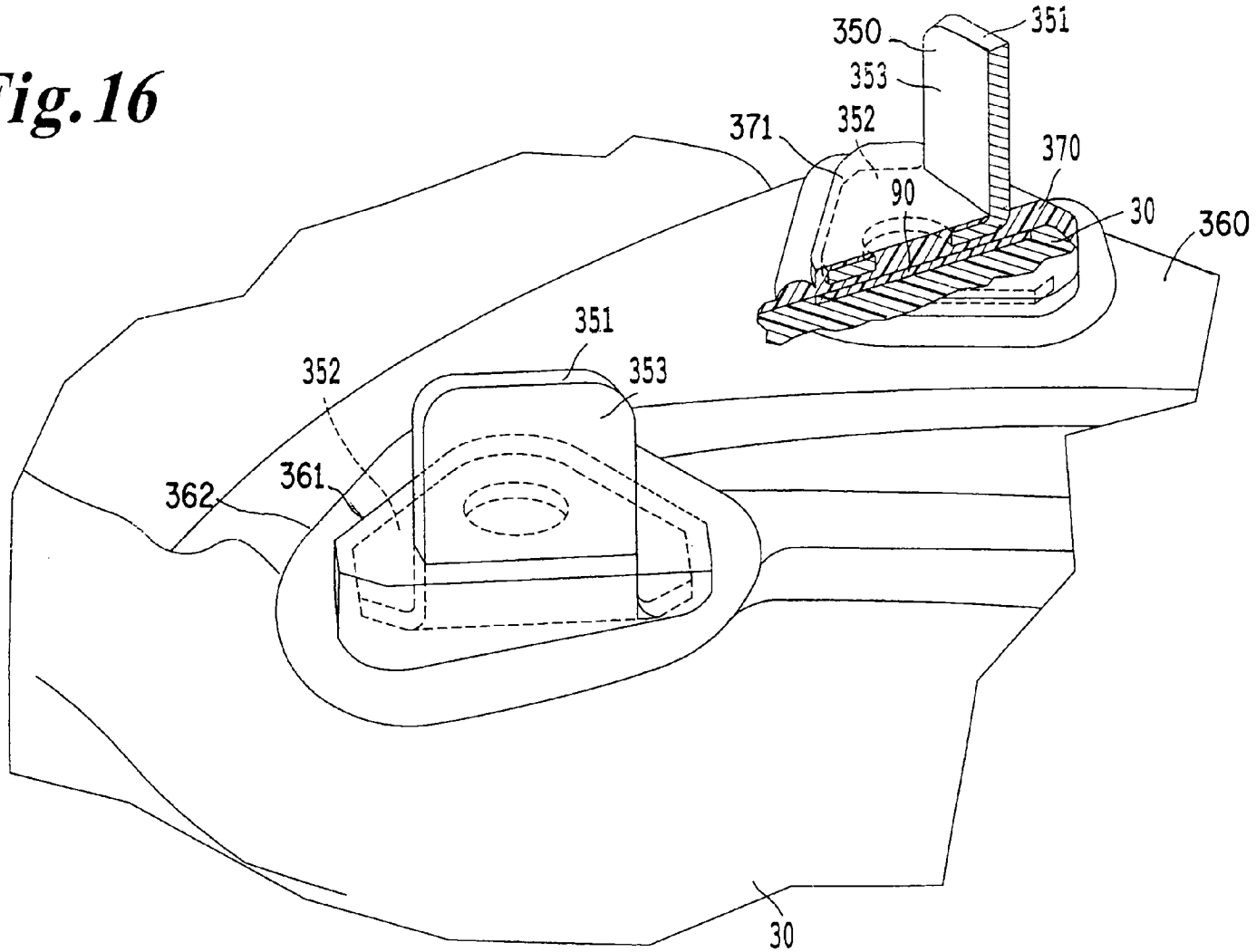
FIG. 16 illustrates an outsole according to an embodiment of the present invention as viewed from the bottom and medial side.

FIG. 15 illustrates a fourth embodiment of the present invention shown from the bottom, showing the lateral 4, medial 5, front 6, and back 7 sides of the shoe 1. A protrusion 364 disposed towards the back side of the shoe may provide additional traction for the wearer. Protrusions 365 disposed closer to the medial side of the shoe and arranged in a helical manner may provide additional traction for the wearer FIG. 16 illustrates an outsole 360 consistent with the fourth embodiment of the present invention. The outsole may have a top outsole surface 361 and a bottom outsole surface 362. The outsole 360 may include a raised portion 370. The raised portion may be made of polyurethane material, thermoplastic urethane, or the like. A blade-like cleat 350 may be integrated with the raised portion 370. The blade-like cleat 350 may be a single piece with a base portion 352 and an extending portion 353. The base portion 352 and the extending portion 353 may be substantially perpendicular to each other. The base portion 352 may be completely integrated with the raised portion 370 while the extending portion 353 protrudes through a bottom surface 371 of the raised portion 370. The extending portion 353 may include a bottom cleat surface 351 designed to contact the ground. The blade-like cleat 350 may include metal.

Figure 17:
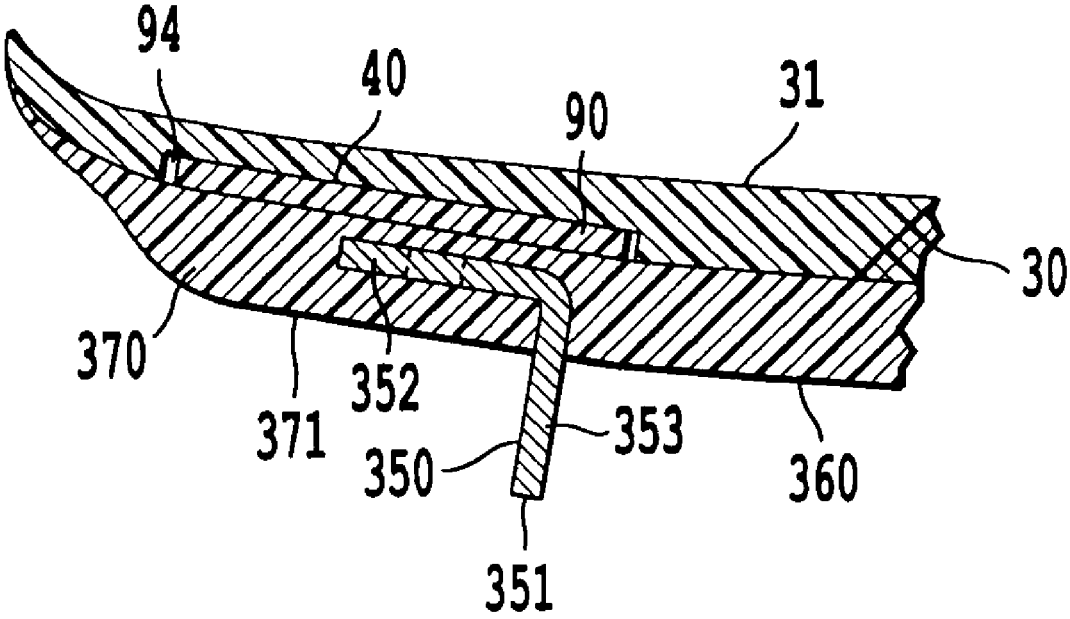
FIG. 17 illustrates a schematic of a cleat assembly of the fourth embodiment as viewed from the rear and medial side.

The primary midsole 30 may be attached to the outsole 360 so that the raised portion 370 may be positioned under the cushion 90, when the cushion 90 is disposed within the sunken midsole area 40 as shown in FIG. 17. The sunken midsole area 40 may be sized larger than the cushion 90 to allow for the cushion 90 to expand unobstructed into an empty space 94 when the cushion is compressed by the top surface of the raised portion 370.

All embodiments of the shoe 1 are intended to be used by the wearer in a similar way. The wearer inserts the foot into the upper opening 9. The wearer fastens the upper 21, as needed, to the foot so that there is a comfortable fit and the foot is disposed between the upper 21 and the lower 20. The wearer may engage in whatever activity desired so that the bottom cleat surface may have a set of impacts with the ground 8. The set of impacts cause a set of forces to be applied to the cleat that are partially dampened by the cushion 90 and further dampened by the primary midsole 30. The dampened set of forces may provide a safer and less tiring experience to the wearer than without damping, particularly as the user travels on a hard surface that do not allow the cleat to penetrate soft ground 8. Further, during the activity the wearer may run side-to-side with quick cuts and the side-to-side forces subsequently created and applied to the outsole 70 may be dampened by the cushion 90 and further dampened by the primary midsole 30. The softness of material used for the cushion 90 allow a much thinner lower to be created and with less weight than if the entire lower were to be manufactured using traditional approaches. When the activity has been completed the wearer merely unfastens the upper 21 as needed and removes the foot from the opening 9.

Further, it should be appreciated that the exemplary embodiments of the invention are not limited to the exemplary embodiments shown and described above. While this invention has been described in conjunction with exemplary embodiments outlined above, various alternatives, modifications, variations and/or improvements, whether known or that are, or may be, presently unforeseen, may become apparent. Accordingly, the exemplary embodiments of the invention, as set forth above are intended to be illustrative, not limiting. The various changes may be made without departing from the spirit and scope of the invention. Therefore, the systems and methods according to exemplary embodiments of this invention are intended to embrace all now known or later-developed alternatives, modifications, variations and/or improvements.

We claim:

1. A shoe including an upper and a lower, the lower comprising:

a primary midsole, the primary midsole including a top midsole surface and a bottom midsole surface, the top midsole surface configured to support toes of a foot, the top midsole surface including a periphery that curves up around a bottom of a heel of the foot, the bottom midsole surface including a sunken midsole area;

a cleat configured to contact the ground with a bottom cleat surface;

an outsole configured to attach to the bottom midsole surface and curving up around the primary midsole, the outsole including a top outsole surface, a bottom outsole surface, and a hollow raised protrusion, the hollow raised protrusion including a bottom raised surface and an outsole inner bore with an outsole opening at one end of the outsole inner bore, the bottom raised surface configured to connect to a top cleat surface; and a cushion including a flexible planar material and sandwiched between the primary midsole and the hollow raised protrusion, the cushion includes a top cushion surface and a bottom cushion surface and a cushion edge, the top cushion surface contacting the sunken midsole area and the bottom cushion surface contacting a top surface of the hollow raised protrusion.

2. The shoe according to claim 1, wherein the outsole further includes a disk cylinder including a support disk which is concentrically connected to a hollow cylindrical body with a threaded internal bore, the disk cylinder configured to be attached to the top outsole surface so as to be concentric to the outsole opening and disposed within the hollow raised protrusion, the threaded internal bore configured to allow insertion and withdrawal of a threaded protrusion into and from the threaded internal bore, the disk cylinder including a top disk surface in contact with the bottom cushion surface.

3. The shoe according to claim 2, wherein the top disk surface is a convex surface curved towards the hollow cylindrical body.

4. The shoe according to claim 3, wherein a portion of the cushion edge is unattached to the outsole and the primary midsole, and the portion of the cushion edge is configured to expand into an empty space in the sunken midsole area or the hollow raised protrusion when the top disk surface is pushed into the cushion.

5. The shoe according to claim 4, wherein the cleat further includes a top cleat surface with a threaded protrusion and the outsole opening is configured to allow insertion and withdrawal of the threaded protrusion into and from the outsole inner bore.

6. The shoe according to claim 5, wherein the cushion includes polymer gel, polyurethane gel, silicone rubber, blown rubber, or polyurethane foam, the primary midsole includes ethylene vinyl acetate, and the disk cylinder includes metal.

7. The shoe according to claim 6, wherein the lower further comprises:

a second cleat configured to contact the ground with a second bottom cleat surface, the second cleat including a second top cleat surface with a second threaded protrusion;

the primary midsole further including a second sunken midsole area;

the outsole further including a second hollow raised protrusion, the second hollow raised protrusion including a second bottom raised surface and a second outsole inner bore with a second outsole opening at one end of the second outsole inner bore, the second outsole opening is configured to allow insertion and withdrawal of the second threaded protrusion into and from the second outsole inner bore, the second bottom raised surface configured to communicate with the second top cleat surface; and a second cushion includes the flexible planar material and disposed between the primary midsole and the second hollow raised protrusion, the second cushion including a second top cushion surface and a second bottom cushion surface and a second cushion edge, the second top cushion surface contacting the second sunken midsole area and the second bottom cushion surface contacting a top surface of the second hollow raised protrusion.

8. The shoe according to claim 7, wherein the outsole further includes a second disk cylinder including a second support disk which is concentrically connected to a second hollow cylindrical body with a second threaded internal bore, the second disk cylinder configured to be attached to the top outsole surface so as to be concentric to the second outsole opening and disposed within the second hollow raised protrusion, the second threaded internal bore configured to allow insertion and withdrawal of the second threaded protrusion into and from the second threaded internal bore, the second disk cylinder including second top disk surface in contact with the second bottom cushion surface.

9. The shoe according to claim 8, wherein the lower further comprises:

the outsole further includes an outsole bridge connecting the hollow raised protrusion and the second hollow raised protrusion, the outsole bridge configured to provide strength to the outsole and prevent the hollow raised protrusion and the second hollow raised protrusion from pulling apart or being pushed together when the cleat or second cleat is under horizontal stress, the outsole bridge is further configured to provide traction with the ground.

10. The shoe according to claim 9, wherein the lower further comprises:

the outsole bridge further includes a spiked protrusion including a back-facing surface, the spiked protrusion configured to assist penetration of ground with a sharp surface facing the ground, the back-facing surface is substantially located in a plane orthogonal to the length of the shoe and configured to assist in further forward traction.

11. The shoe according to claim 10, wherein the lower further comprises:

the raised protrusion disposed near the medial side of the shoe and the second raised protrusion disposed near the lateral side of the foot.

12. The shoe according to claim 1, wherein the cushion has a circular outer shape.

13. The shoe according to claim 1, wherein the cushion is located only above the cleat and the hollow raised protrusion.

14. A shoe including an upper and a lower, the lower comprising:

a primary midsole, the primary midsole including a top midsole surface and a bottom midsole surface, the top midsole surface configured to support toes of a foot, the top midsole surface including a periphery that curves up around a bottom of a heel of the foot, the bottom midsole surface including a sunken midsole area;

a cleat configured to contact the ground with a bottom cleat surface;

an outsole configured to attach to the bottom midsole surface and curving up around the primary midsole; and a cushion including a flexible planar material, the cushion includes a top cushion surface contacting the sunken midsole area, wherein the cleat is connected to the outsole, the cushion is disposed between the midsole and the outsole, and the cushion is located only above the cleat.

15. The shoe according to claim 14, wherein the cushion includes polymer gel, polyurethane gel, silicone rubber, blown rubber, or polyurethane foam.

16. The shoe according to claim 14, wherein the cushion has a circular outer shape.

17. The shoe according to claim 14, wherein the cleat is molded to the outsole.

18. The shoe according to claim 14, wherein the cleat is configured to be removable from the outsole.

19. A shoe including an upper and a lower, the lower comprising:

a primary midsole, the primary midsole including a top midsole surface and a bottom midsole surface, the top midsole surface configured to support toes of a foot, the top midsole surface including a periphery that curves up around a bottom of a heel of the foot, the bottom midsole surface including a sunken midsole area;

a cleat configured to contact the ground with a bottom cleat surface, the cleat including a base portion and an extending portion;

an outsole configured to attach to the bottom midsole surface and curving up around the primary midsole, the outsole including a top outsole surface, a bottom outsole surface, and a raised portion; and a cushion including a flexible planar material and sandwiched between the primary midsole and the raised portion, the cushion includes a top cushion surface and a bottom cushion surface and a cushion edge, the top cushion surface contacting the sunken midsole area and the bottom cushion surface contacting a top surface of the raised portion, wherein the base portion of the cleat is integrated with the raised portion and the extending portion of the cleat protrudes through a bottom surface of the raised portion.

20. The shoe according to claim 19, wherein the cleat includes metal.

21. The shoe according to claim 19, wherein the cushion includes polymer gel, polyurethane gel, silicone rubber, blown rubber, or polyurethane foam.

22. The shoe according to claim 19, wherein the cushion is located only above the cleat and the raised portion.

23. The shoe according to claim 19, wherein the outsole includes a plurality of protrusions disposed near a medial side of the shoe arranged in a helical manner.

24. The shoe according to claim 19, wherein the base portion of the cleat and the extending portion of the cleat are substantially perpendicular to each other.

25. The shoe according to claim 19, wherein a portion of the cushion edge is unattached to the outsole and the primary midsole, and the portion of the cushion edge is configured to expand into an empty space in the sunken midsole area when the top surface of the raised portion is pushed into the cushion.

* * * * *